United States Patent [19]

Hertzog

[11] Patent Number: 5,010,603

[45] Date of Patent: Apr. 30, 1991

[54] MODULAR ABOVE GROUND SWIMMING POOL

[76] Inventor: Lewis R. Hertzog, 167 N. Bingaman St., Reading, Pa. 19606

[21] Appl. No.: 463,568

[22] Filed: Jan. 11, 1990

[51] Int. Cl.[5] ..... E04H 4/00; E02D 27/00

[52] U.S. Cl. ..... 4/506; 4/488; 4/513; 52/169.7

[58] Field of Search ..... 4/506, 488, 513; 52/169.7

[56] References Cited

U.S. PATENT DOCUMENTS

| | | | |
|---|---|---|---|
| 3,317,927 | 5/1967 | Shields | 4/506 |
| 3,335,430 | 8/1967 | Schwarz et al. | 4/506 |
| 3,518,704 | 7/1970 | Shanni | 4/506 |
| 3,579,665 | 5/1971 | Barker | 52/169.7 |
| 3,793,651 | 2/1974 | Pitti et al. | 52/169.7 |
| 3,815,162 | 6/1974 | Hall | 4/506 |
| 3,840,908 | 10/1974 | Greene | 4/506 |
| 3,955,220 | 5/1976 | Kessler | 4/506 |
| 4,020,509 | 5/1977 | West | 4/506 |
| 4,055,922 | 11/1977 | Ellington et al. | 4/506 |
| 4,077,173 | 3/1978 | Rozanski | 52/169.8 |
| 4,137,576 | 2/1979 | Greene | 4/506 |
| 4,283,804 | 8/1981 | Mahoney | 4/506 |
| 4,464,802 | 8/1984 | Glonek et al. | 4/506 |
| 4,562,603 | 1/1986 | Paradis | 4/506 |
| 4,635,304 | 1/1987 | Zikmanis et al. | 4/506 |

OTHER PUBLICATIONS

The Boardwalk Pool by Hercules Products; 1 Page Brochure, Hercules Products Inc., 2968 Nationwide Pkwy., Brunswick, Ohio 44212.

*Primary Examiner*—Henry J. Recla
*Assistant Examiner*—Antoine Gamarra
*Attorney, Agent, or Firm*—Arthur J. Plantamura

[57] ABSTRACT

An improved swimming pool construction of the kind capable of being erected, at least substantially, above ground on a substantially flat surface is provided. The swimming pool is of a construction whose modular components are prefabricated and delivered to the building site for assembly. A bracing member comprised of four cut pieces of standard construction lumber, and provided in pre-assembled modular form, provides load bearing qualities that afford sufficient strength without the need to supply any additional support means that are anchored in the ground. The swimming pool is fabricated from a plurality of wall panels that are secured end-to-end and form the periphery of the swimming pool and contain integrally formed flanges that retain the brace in position. The prefabricated pool delivered to the building site as a package, employs an arrangement of modular elements to provide a self standing swimming pool that can be assembled, using only hand tools to lock together the respective modular parts. The modular brace which integrates the entire swimming pool performs the triple function of affording strengthening means to resist buckling of the wall panels from water pressure, supports a deck and is used to secure a screening/protective fence surrounding the periphery and above the top of the swimming pool wall.

7 Claims, 2 Drawing Sheets

MODULAR ABOVE GROUND SWIMMING POOL

This invention relates to an improved swimming pool construction and more particularly to a swimming pool of the kind capable of being erected, at least substantially, above ground on a substantially flat surface. The swimming pool of the invention is of a construction whose modular components provide load bearing qualities that afford sufficient strength without the need to supply any additional support means that must be anchored in the ground. The swimming pool of the invention is of the kind that is fabricated from a plurality of wall panels that are secured end-to-end and form the periphery of the swimming pool and is provided with strengthening means which resist buckling buckling of the wall panels from water pressure and which supports a deck and screening/protective fence surrounding the periphery and above the top of the swimming pool wall.

BACKGROUND OF THE INVENTION

Various swimming pool constructions which employ an assembly of modular wall panels connected end-to-end to form the perimeter of a swimming pool and include accessory related modular components to provide a self standing swimming pool are known. All such known constructions, however appear to require some substantial on-site building, at least with respect to reinforcement and/or stabilizing, as distinguished from solely assembling and securing modular components that are delivered to a buiding site.

Because of the high and rising cost of labor, it is increasingly important, from a cost standpoint and to promote affordability of swimming pool of this kind, that the labor required in building a swimming pool be kept to a minimum. Obviously when it is necessary to "tailor make" the the component parts of the swimming pool at the building site, this has a direct effect in raising the cost to the consumer for such pools.

It is thus apparent that a need exists for an improved above ground swimming pool of the kind wherein essentially all the components of the structure are prefabricated as modular units and brought onto the building site in a package and wherein the on-site labor requirements is limited essentially to the assembly of the modular components to provide a completely finished swimming pool including bracing means, peripheral deck and screening/protective fence surrounding the swimming pool.

SUMMARY OF THE INVENTION

An important objective of the invention is to provide an above ground swimming pool whose component parts are prefabricated into modular units which are prepackaged by the manufacturer and are delivered to and assembled on the construction site.

It is another object of the invention to provide an above ground swimming pool which is composed entirely of modular prefabricated components which are brought to the building site and which can be entirely assembled with small hand tools in a relatively brief period of time.

It is a further and more particular object of the invention to provide an improved above-ground swimming pool modular brace which can be assembled and held on the swimming pool wall panel in a bracing disposition without the aid of tools, said brace providing essentially the entire support for the peripheral swimming pool wall, for the surrounding deck and for the protective fence which surrounds the swimming pool above the level of the swimming pool wall.

It is still another object of the invention to provide an improved unitary modular swimming pool brace which includes an integral recess to receive therein a swimming pool deck module and which is capable of being locked at the back of and supporting the swimming pool wall panels and the peripheral deck in an interlocked relationship without modification of the several parts and without the aid of tools; it being necessary only to fasten, i.e., tack, the brace to the pool wall to prevent shifting of the aligned parts.

It is further and particular object of the invention to provide an above-ground swimming pool whose brace and deck modules are formed entirely of cut to length pieces of standard construction lumber that are preformed into rigid finished ready to assemble units that are conveniently deliverable to a building site.

These and additional objects, features and advantages of the invention wil be better understood and appreciated from a consideration of the following detailed description taken in conjunction with the accompanying drawing.

DETAILED DESCRIPTION OF THE PREFERRED EMBODIMENT

Figure 1:
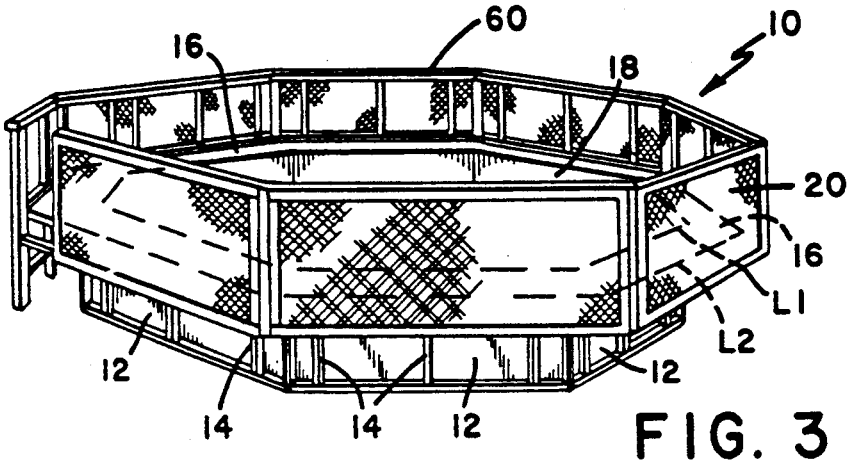
FIG. 1 is a perspective illustration of a swimming pool of the kind constructed in accordance with the invention, having a generally circular configuration and comprised of modular wall panels joined in end-to-end relationship.
Figure 2:
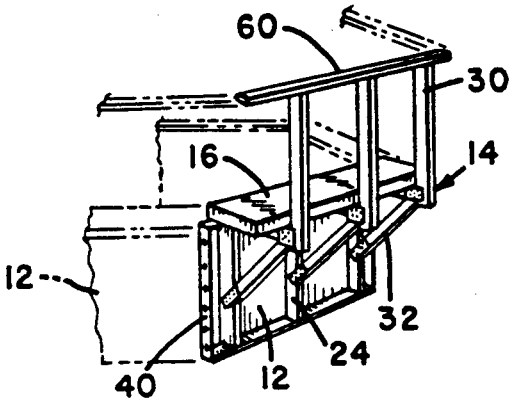
FIG. 2 is a fragmentary perspective view showing a part of the swimming in phantom and a modular wall panel with braces and a deck module on the braces.
Figure 3:
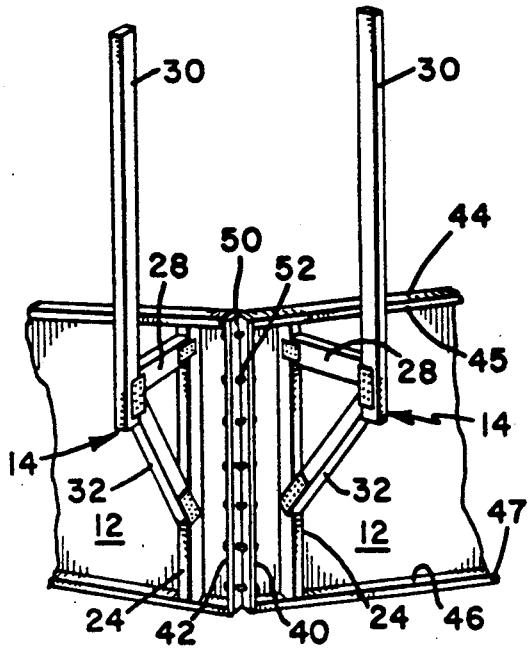
FIG. 3 is an enlarged fragmentary view showing the joinder of two of the modular wall panels with a brace in place on each of the wall panels that form the swimming pool peripheral wall.
Figure 4:
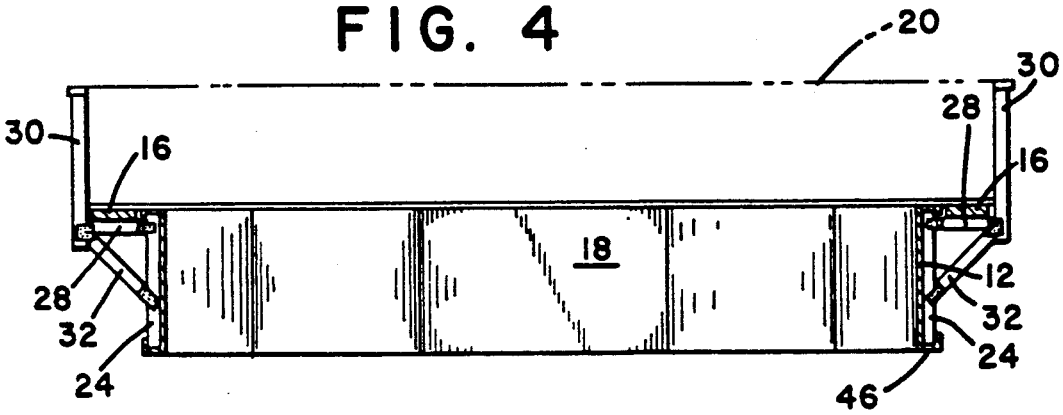
FIG. 4 is a side elevational view of the swimming pool with the modular brace in position and a deck module nested in a recess formed in the brace and at the top of the swimming pool wall.

With reference to the drawing, a generally circular above-ground swimming pool formed from a plurality of straight modular side-wall panels 12 supported by brace members 14 and provided with a deck 16 and a protective fence or lattice structure 20 around the pool above the deck level. A vinyl liner 18 is suspended from below the deck 16 as will be described in greater detail hereinafter.

The wall member 18 comprises a rectangular sheet metal configuration preferably treated to resist corrosion such as by galvanizing or by plastic coating by any of several methods known in the art of protective metal coating. The rectangular wall members 18 are provided with a flanges on each of its four sides which extend generally at a right angle rearwardly from the face of the panel; a left side end flange, and a right side end flange which are used in joining contiguous adjacent wall panels to form the perimeter of the swimming pool and a top and bottom flange each of which has additionally at the end thereof a second flange or lip which extend toward the opposite second flange and are used to contain the brace ends in a manner detailed hereinafter.

Referring in particular to the detailed illustrations of FIGS. 2–5, it is seen that the brace member 14 provides the backing for the modular wall members 12, an under support for deck 16 and a support for the fence or shroud arrangement 20. The modular brace, whose details are shown more clearly by reference to FIG. 5, comprises four pieces, i.e. lengths, cut from standard building, preferably 2×4, lumber:

a first vertical piece 24 whose top and bottom ends are left free to enter into the top and bottom flanges integrally formed at the back of the modular wall panels as will be described in greater detail;

a horizontal piece or length 28 entends substantially at right angle from close to, but spaced from, the top of first vertical piece and which supports the underside of a deck module 16;

a second vertical length 30 which extends upward from the horizontal piece 28 in a substantially parallel spaced relation to the first piece 24 and affords support for the fence or shroud 10; and a fourth diagonal brace segment 32 which is preferably secured to the first vertical piece 14 at a point approximately one-third of the distance up from the bottom.

The attachment of the diagonal member at this point on the first vertical leg 24 affords maximum resistance to the force exerted by the weight of the water in the swimming pool against the wall panels and brace member 14. The diagonal member 32 is secured at the upper or opposite end at the juncture of the second vertical member 30 and the horizontal member 28. These four brace segments 24, 28, 30 and 32 are secured essentially permanently to provide a unitary rigid brace which is prefabricated and delivered to the construction site as a modular piece of the swimming pool package. While various means may be employed to substantially permanent secure or lock the four brace segments 24, 28, 30 and 32 to make the prefabricated brace module 14, it is preferred to use "gang" nailers or joinder plates to lock these members of the brace in the desired relationship. Such gang nailers are known in the lumber construction art and are available in different sizes, i.e., encompassing various areas, such that, for example, when joining more than two pieces at a juncture, as shown for example in the upper right joint of FIG. 5, a larger nailer 36 is used relative to the nailers 34 and 35 which are used in joining two members only. These nailers comprise a multiplicity of spaced pointed prongs integrally formed preferably with a slight twist that extend from one face of the nailers 34, 35 and 36. In locking the segments 24, 28, 30 and 32 of the brace 14 to comprise the preformed modular unit, one such nailer is positioned on both sides with the sharp prongs on the joint and the nailers under suitably high pressure, i.e., in a press capable of exerting high pressure, are forced into the wood to a point where the outer surface of the nailer plates are substantially flush with the wood surface contiguous thereto. The segments are thereby locked in the desired configuration.

The swimming pool of the invention is devised for easy assembly from the various modular components all of which may generally be brought to the building site as a package, e.g., on a pallet, and the swimming pool assembled in a matter of hours using essentially only a screw driver and a wrench, and preferably powered tools of this kind.

Figure 8:
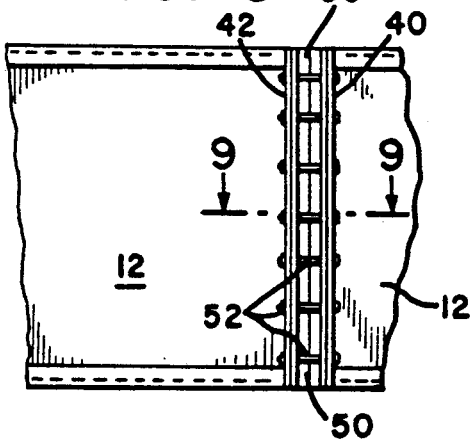
FIG. 8 is an enlarged view of the connection between the two modular wall panels in which a V-shaped filler insert is located at the joint with curved bolts passing therethrough and through the flanges of the two contiguous side panels.
Figure 9:
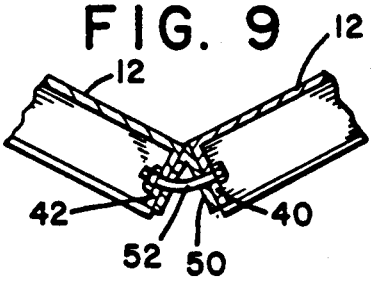
FIG. 9 is an enlarged view taken along line 9—9 of FIG. 8.

The modular wall panels 12, as seen by reference to the details of FIG. 8 and 9, are joined and secured through side flanges 40 and 42 which are disposed rearwardly and at essentially right angle to the face of the panel 12 and are integrally formed on the panel 12. In securing the panels, bolts 52 are preferably used. The bolts 52 are inserted through mating holes predrilled in the flanges 40 and 42. When adjacent panels 12 are secured in other than a straight line, such as when a a circular swimming pool is erected, the opening or notch at the connection between the two panels (see FIG. 9) is preferably filled with a V-shaped filler strip 50 of metal or other durable suitable composition. This strip 50 is suitably pre-drilled with holes corresponding to those in the flanges of the panels and substantially closes the notch formed by the outside ends of the wall panel side flanges 40 and 42. Also, to facilitate the connections curved fastening bolts 52 which pass through the preformed alligned holes in the contiguous panel flanges 40 and 42 and the pre-formed holes in the filler piece 50 are preferably employed. In those instances where there is some slight misallignment or deviation of the level of the swimming pool, a flat builder's block (not shown) may be positioned on the ground to provide a desired lift at the point of joinder of two contiguous wall panels.

Figure 6:
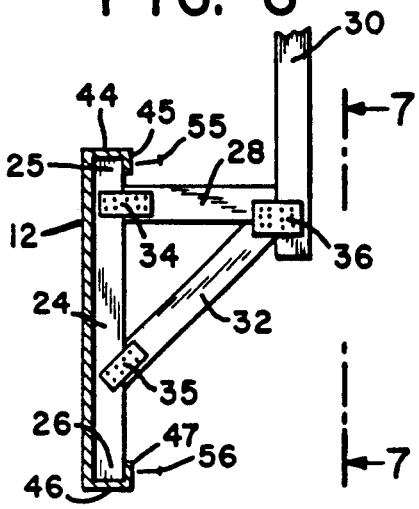
FIG. 6 illustrates the brace in vertical position in the flanges formed at the top and bottom at the back of the modular side wall panels.
Figure 7:
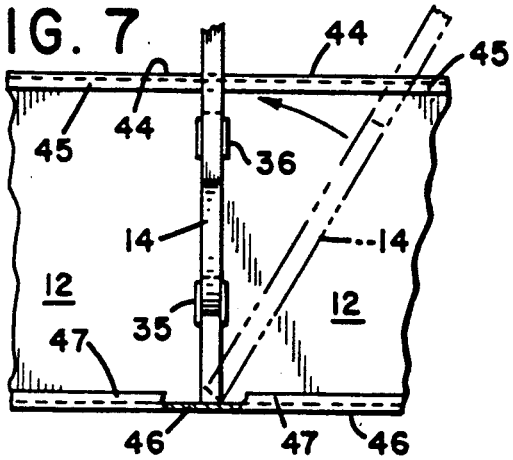
FIG. 7 is a view taken along line 7—7 of FIG. 6 illustrates the insertion of the brace into vertical allignment at the back of the modular wall panel.

The securing of the brace 14 at the rear of the modular wall panel 12 is described by reference to FIGS. 6 and 7. The brace 14 is shown in broken line in FIG. 7 at an angle from vertical, preperatory to assembling on the wall. Because the brace piece 14 is pre-cut to the measured, inside distance between the top and bottom of flanges 44 and 46 of wall panel 12, the brace 14 is angled sufficiently during the assembly so that the upper and lower ends 25 and 26 of the first vertical brace piece 24 can be inserted in the flanges as the brace 14 is moved to the vertical position, i.e., inserted behind the lips or upper and lower flanges 45 and 47 that are formed at the ends of the flanges 44 and 45 which extend from the face of the panel 12. Upon vertical disposition behind flanges 45 and 47, of the ends 25 and 26 of the brace 24, the brace is essentially retained in position. To avoid accidental movement from the desired allignment, the brace is tacked. For this purpose, screws 55 and 56 are driven into the wood through pre-formed holes in the upper and lower flanges 45 and 47 and into the upper and lower ends 25 and 26 of the brace piece 24.

Figure 5:
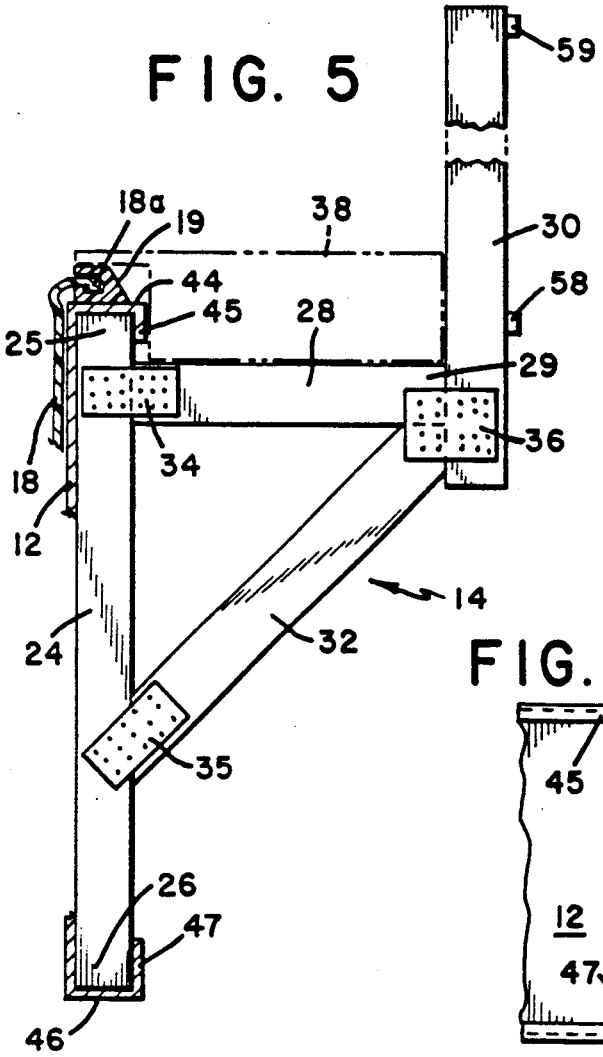
FIG. 5 is an enlarged side elevational view of the brace of the invention illustrating a preferred form using gang nailers for securing the brace pieces into a rigid, integral unit.

As shown in FIG. 5, a conventional bead retainer 19 to house the upper peripheral bead **18*a* of a swimming pool vinyl liner 18 is secured at the top of the wall 12 before the deck 16 is placed on the horizonal brace piece 28. The brace 14 is devised so that it fits and is held snugly behind the flanges 45 and 47 as heretofore noted by employing the free portion 25 at the top of the first brace piece 24. The extension, together with the upward extending brace 30 forms a recess bottoming on the horizontal brace piece 28 which receives the deck module 16 in a snug, forced fit, securing the bead receiver 19**.

In retaining the lattice fencing 20, or other suitable type fence or shroud, suitable retaining strips 58 and 59 may be secured as by nailing or with screws on the brace upright 30 upon which the fencing 20 is secured and topped with an appropriate railing 60.

The following describes the manner of installation of the swimming pool of the present invention. Once a suitable level site for the swimming pool is prepared and the modular units comprising the swimming pool package are brought to the site, the modular wall panels 12 are joined and secured end-to-end by bolting together through the end flanges 40 and 42 preferably including the V-notch pieces 50 and the panel side flanges are secured by bolt 52. If necessary, to improve the level of the wall, shim blocks (not shown) may be placed on the ground underneath one or more points generally at a connection between two contiguous panels. The preformed four-piece brace 14 as shown in enlarged detail in FIG. 5 is then positioned against the back of the wall member, angularly displaced sufficiently to permit entry of the top and bottom ends 25 and 26 into the channel areas formed at the back of the wall 12 by flanges 45 and 46 respectively, and the brace is brought to a vertical position and thereby locking the braces in allignment at pre-drilled holes into the ends 25 and 26. A vinyl liner bead retainer 19 is then attached at the top of the wall member 12 with the bead receiving opening facing inside the swimming pool preperatory to receiving the bead 18*a* of the vinyl liner which is draped around the interior of the swimming pool. Usually, installation of the liner is reserved until the pool structure is completed, i.e., following installation of the deck 16 and fence 20. Upon installation of the brace 14 and the liner bead receiver 19, the deck module each of which is essentially of a length coextensive with the length of a wall module at the inner edge of the the deck module L1 and a correspondingly longer length L2 (see FIG. 1) at the outer edge of the deck module 16 because of the relatively large radius of the deck 16. The deck module 16 is sized to be snugly deposited in the above described recess that is formed on the brace piece 28 between the outer face of the top 25 of member 24 and the inner face of the member 30. Thereafter suitable railing strips such as 58 and 59 are secured on the second vertical piece 30 to serve as means to attach the enclosing protective fence 20. When the pool is essentially erected, the bead 18*a* formed at the top of the flexible vinyl liner 18 which holds the liner in position is inserted in the bead retainer 19 preperatory to filling the swimming pool with water.

While the preferred embodiments of the invention have been disclosed in detail, it is to be understood that various alternative details or equivalents which fall within the scope of the invention as claimed may be adapted by those skilled in the art.

What is claimed is:

1. An above ground swimming pool comprising a plurality of modular components each of which is prefabricated and ready for assembly in combination at the construction site each including:

(a) a modular wall panel formed integrally with a rearwardly extending flange (i) at each of the sides of the panel for securing a contiguous panel through said flange to a contiguous panel to form a continuous swimming pool perimeter wall and (ii) at the top and at the bottom of each modular panel, said top flange and bottom flange being provided further with a brace-end confining lip or second flange extending from the end of each of said top and bottom flange and toward the opposite flange and in a direction substantially parellel to the said panel wall;

(b) a unitary modular brace for supporting each of a swimming pool wall, a deck at the top of said wall at the periphery of the swimming pool and a protective fence positioned above the swimming pool wall and comprised of four linear pieces of cut standard construction lumber and locked in a modular configuration and including (i) a first vertical piece whose top and bottom ends are inserted, respectively, in the said top and bottom wall panel flanges to brace the swimming pool wall panel at the backside of the panel, (ii) a deck supporting piece secured to and near the top of said first vertical piece and extending horizotally rearwardly from said first vertical piece and secured at its opposite end to (iii) a second vertical piece which extends upward from a horizontal deck supporting piece, said horizontal piece being located at a point below the top of said first vertical piece a distance substantially equal to the width of said standard lumber and such that a deck receiving recess is provided on the horizontal piece between said first and second vertical pieces, and (iv) a diagonal piece to secured at its lower end on the lower part of said first vertical piece and at its upper end at the juncture of the said horizontal deck supporting piece and the lower end of said second vertical piece;

(c) a preformed modular deck complimentally configured to and received in said recess between said first and second vertical pieces and resting on said horizontal piece, and (d) a screen or fence secured on said second vertical piece and providing an enclosure at the top of and surrounding the the swimming pool wall.

2. The swimming pool of claim 1 wherein the wall panel module is comprised of sheet metal.

3. The swimming pool of claim 1 wherein the four brace pieces are locked in a rigid preformed module by gang nailers pressed into joined ends and at each side of said pieces.

4. The swimming pool of claim 1 wherein the lower end of said diagonal piece (iv) of the modular brace (b) is secured on said first vertical piece at a point upward from the bottom on said vertical piece which affords optimum resistance to a force applied by water in the swimming pool against the pool wall and the said first vertical piece of the brace (b).

5. The swimming pool of claim 1 in which a vertical filler piece having a substantially V-shaped cross section is inserted in the joint between two contiguously joined wall panels.

6. The swimming pool of claim 5 in which curved fastening securing bolts are passed transversely through the contiguous side flanges of adjacent joined wall panels and the intervening filler piece between between the flanges.

7. A method of assembling an above ground swimming pool from a plurality of modular components each of which is prefabricated and ready for assembly in combination at the construction site comprising, forming a swimming pool enclosure wall from a plurality of modular wall panels having rearwardly extending side flanges that are formed integrally with the panel for securing contiguous panel through said flange to form a continuous swimming pool perimeter wall, providing integrally formed top and bottom flanges at the top and bottom edges of each modular wall panel, said top flange and bottom flange being provided with a brace-end confining lip or second flange extending toward the opposite flange, providing a modular brace formed from four cut pieces of standard construction lumber that are locked into an integral fixed configuration for supporting each of a swimming pool wall, a deck at the top of said wall at the periphery of the swimming pool and a protective fence positioned above the swimming pool wall wherein the four pieces include a first vertical piece whose opposite ends are free, positioning the first vertical piece of the modular brace at an angle from vertical against the back of the modular wall panel, and twisting it to a vertical position to insert the free ends of the first vertical piece behind the said upper and lower brace end confining lips of the modular wall panel to brace the swimming pool wall panel at the backside of the panel, providing a deck supporting horizontal piece secured at one end to and near the top of said first vertical brace piece and extending horizontally rearwardly from said first vertical piece and connected at the other end to a second vertical piece which extends upward from said deck supporting piece, locating said horizontal piece at a point below the top of said first vertical piece a distance substantially equal to the width of said standard lumber and such that a deck receiving recess is provided on the horizontal piece between said first and said second vertical pieces, providing a preformed modular deck complimentally configured to said recess and inserting said deck in said recess between said first and second vertical pieces, providing a diagonal piece secured at its lower end on said first vertical piece and at its upper end at the juncture of said horizontal deck supporting piece and the lower end of said second vertical piece, and securing an enclosure at the top of and surrounding the swimming pool wall on said second vertical piece.

* * * * *